US008580476B2

(12) United States Patent
Yamada et al.

(10) Patent No.: US 8,580,476 B2
(45) Date of Patent: Nov. 12, 2013

(54) METHOD FOR PREPARING PARTICULATE RELEASE AGENT, TONER USING THE PARTICULATE RELEASE AGENT, AND METHOD FOR PREPARING THE TONER

(75) Inventors: Masahide Yamada, Shizuoka (JP); Chiaki Tanaka, Shizuoka (JP); Masahiro Kawamoto, Shizuoka (JP); Tatsunori Kamiyama, Shizuoka (JP); Satoshi Izumi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 290 days.

(21) Appl. No.: 13/047,140

(22) Filed: Mar. 14, 2011

(65) Prior Publication Data

US 2011/0236818 A1 Sep. 29, 2011

(30) Foreign Application Priority Data

Mar. 25, 2010 (JP) ..... 2010-070030

(51) Int. Cl.
*G03G 9/097* (2006.01)

(52) U.S. Cl.
USPC ..... 430/137.19; 264/5

(58) Field of Classification Search
USPC ..... 430/137.1, 137.19, 137.14; 264/5, 12, 264/8, 9
See application file for complete search history.

(56) References Cited

U.S. PATENT DOCUMENTS

| | | | | |
|---|---|---|---|---|
| 4,996,127 | A | 2/1991 | Hasegawa et al. | |
| H1839 | H * | 2/2000 | Combes et al. | 528/483 |
| 6,326,115 | B1 | 12/2001 | Nakanishi et al. | |
| 6,596,454 | B2 | 7/2003 | Adachi et al. | |
| 6,858,369 | B1 | 2/2005 | Adachi et al. | |
| 7,629,104 | B2 | 12/2009 | Tanaka et al. | |
| 2006/0145375 | A1 * | 7/2006 | Chattopadhyay et al. | 264/13 |
| 2007/0102836 | A1 | 5/2007 | Mishima et al. | |
| 2008/0227018 | A1 * | 9/2008 | Awamura et al. | 430/110.4 |

FOREIGN PATENT DOCUMENTS

| | | |
|---|---|---|
| JP | 2537503 | 7/1996 |
| JP | 9-34167 | 2/1997 |
| JP | 11-149180 | 6/1999 |
| JP | 2001-312098 | 11/2001 |
| JP | 3246394 | 11/2001 |
| JP | 3456372 | 8/2003 |
| JP | 2006-346557 | 12/2006 |
| JP | 2007-72444 | 3/2007 |
| JP | 4373884 | 9/2009 |
| JP | 4390664 | 10/2009 |
| WO | WO 2005/073285 A1 | 8/2005 |

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A toner for developing an electrostatic image is provided. The toner includes at least a binder resin; a colorant; and a particulate release agent. The particulate release agent is prepared by heating the release agent to a temperature not lower than a melting point of the release agent to melt the release agent, dissolving the melted release agent in a supercritical fluid or a sub-critical fluid, and feeding the solution into a liquid so that the solution is depressurized and the particulate release agent is formed in the liquid.

4 Claims, 1 Drawing Sheet

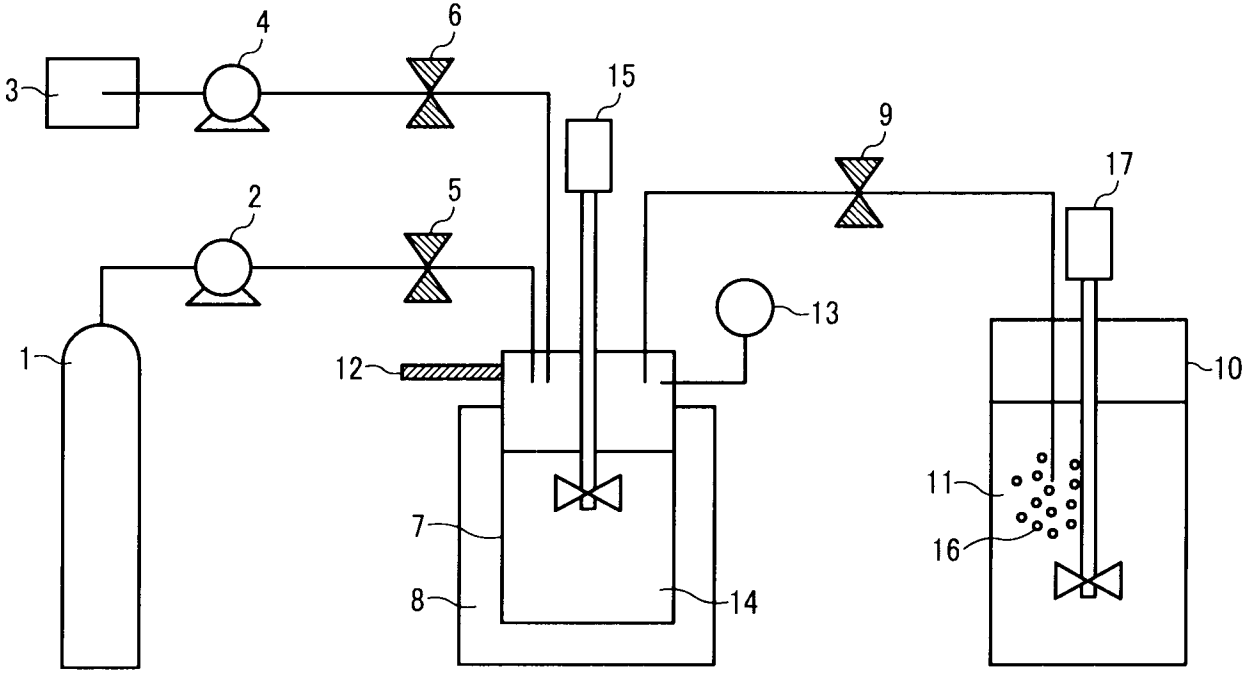
1
2
3
4
5
6
7
8
9
10
11
12
13
14
15
16
17

METHOD FOR PREPARING PARTICULATE RELEASE AGENT, TONER USING THE PARTICULATE RELEASE AGENT, AND METHOD FOR PREPARING THE TONER

BACKGROUND OF THE INVENTION

1. Field of the Invention

The present invention relates to a method for preparing a particulate release agent, and to a toner including the particulate release agent. In addition, the present invention relates to a method for preparing the toner.

2. Description of the Related Art

Electrophotographic image forming methods typically include the following processes:

(1) Forming an electrostatic latent image on an image bearing member such as a photoreceptor (latent image forming process);

(2) Developing the electrostatic latent image with a developer including a toner to form a toner image on the image bearing member (developing process);

(3) Transferring the toner image onto a recording material such as a paper sheet (transferring process); and (4) Fixing the toner image on the recording material upon application of heat, pressure, a combination of heat and pressure, a vaporized solvent, or the like, resulting in formation of an output image (fixing process).

The developing methods are broadly classified into wet developing methods using a liquid developer including an insulating organic solvent and a pigment or dye dispersed therein, and dry developing methods (such as cascade developing methods, magnetic brush developing methods and powder cloud developing methods) using a dry toner including a binder resin and a colorant dispersed therein. Recently, dry developing methods are widely used.

The methods for preparing toner are broadly classified into dry methods typified by pulverization methods in which toner components such as binder resins and colorants are kneaded and the kneaded toner components are pulverized, followed by classification to prepare toner particles, and wet methods typified by polymerization methods in which toner particles are prepared using a suspension polymerization method or a polymer emulsion aggregation method. When pulverization methods are used, it is necessary to prepare toner particles having as small weight average particle diameter as possible to produce images having a good combination of resolution and half toner property. If fine toner particles having a particle diameter of not greater than 4 μm and coarse toner particles having a particle diameter of not less than 15 μm are removed in the classification operation to produce high quality images, the yield of toner deteriorates. In addition, pulverization methods have drawbacks in that it is hard to evenly disperse a colorant and a charge controlling agent in a thermoplastic resin, i.e., a colorant and a charge controlling agent are unevenly dispersed in a thermoplastic resin (binder resin), thereby deteriorating the properties of the toner such as fluidity, developing property, durability and image quality.

In attempting to remedy the drawbacks of the pulverization methods, polymerization methods such as suspension polymerization methods and polymer emulsion aggregation methods, in which a polymer emulsion, a colorant and a charge controlling agent are mixed and the mixture is heated to aggregate the polymer, resulting in formation of toner particles, have been proposed.

In addition, there are proposals for a granulation method in which a toner including a polyester resin is granulated in water using an organic solvent, and a polymerization method in which a prepolymer having an isocyanate group is reacted with an amine compound to prepare toner particles.

Heat fixing methods using a heated fixing member such as rollers have been mainly used for the fixing process. In order to prevent adhesion of toner images to such a heated fixing member, a technique in that an oil is applied to a fixing member has been used. Recently, a technique in that a release agent is included in toner has been mainly used to prevent adhesion of toner images to a heated fixing member. However, such a toner often causes a toner adhesion problem in that the toner adheres to an image bearing member.

For these reasons, the present inventors recognized that there is a need for a toner which can be produced at a high yield although the toner has a small average particle diameter and includes a release agent and which can produce high quality images over a long period of time without causing the toner adhesion problem.

SUMMARY

This patent specification describes a novel toner for use in developing an electrostatic latent image, one embodiment of which includes a binder resin, a colorant and a particulate release agent, wherein the particulate release agent is prepared by heating the release agent to a temperature not lower than the melting point of the release agent to melt the release agent, dissolving the melted release agent in a supercritical fluid or a sub-critical fluid, and feeding the solution into a liquid to depressurize (i.e., quickly expand) the solution, so that the particulate release agent is formed in the liquid.

This patent specification describes a novel method for preparing a particulate release agent, one embodiment of which includes heating a release agent to a temperature not lower than the melting point of the release agent to melt the wax; dissolving the melted release agent in a supercritical fluid or a sub-critical fluid; and feeding the solution into a liquid to depressurize (i.e., quickly expand) the solution, so that the particulate release agent is formed in the liquid.

This patent specification describes a novel method for preparing a toner, one embodiment of which includes heating a release agent to a temperature not lower than a melting point of the release agent to melt the release agent; dissolving the melted release agent in a supercritical fluid or a sub-critical fluid; feeding the solution into a liquid to depressurize the solution to prepare a particulate release agent; dissolving or dispersing toner components including at least a compound having an active hydrogen atom, a polymer having a group reactive with the compound, a binder resin, a colorant and the particulate release agent in an organic solvent to prepare an oil phase liquid; dispersing the oil phase liquid in an aqueous medium including a particulate resin to prepare an emulsion; reacting the compound having an active hydrogen atom with the polymer; and removing the organic solvent from the emulsion to prepare the toner particles, wherein the solvent removing step is performed while or after the reacting step is performed.

The liquid into which the solution is fed is preferably an organic solvent solution of the binder resin.

BRIEF DESCRIPTION OF THE DRAWINGS

A more complete appreciation of the aspects of the invention and many of the attendant advantage thereof will be readily obtained as the same better understood by reference to the following detailed description when considered in connection with the accompanying drawings, wherein:

FIGURE is a schematic view illustrating an example of a manufacturing equipment for use in the release agent preparation method of the present invention.

DESCRIPTION OF THE PREFERRED EMBODIMENTS

Initially, the toner of the present invention will be described.

The toner of the present invention includes a particulate release agent prepared by using a supercritical fluid or a sub-critical fluid. Such a release agent has a sharp particle diameter distribution. A supercritical fluid is defined as a material (fluid) which is present as a non-condensable high density fluid in a temperature/pressure range over the critical point thereof, below which a gas of the material and a liquid of the material can coexist. Namely, a supercritical fluid does not cause condensation and has a temperature higher than the critical temperature and a pressure higher than the critical pressure. The supercritical fluid for use in the present invention is not particularly limited as long as the fluid has this property, but it is preferable to use a supercritical fluid having a relatively low critical temperature.

A sub-critical fluid is defined as a material (fluid) which is present as a high pressure liquid in a temperature/pressure range in the vicinity of the critical point thereof. The sub-critical fluid for use in the present invention is not particularly limited as long as the fluid has this property. Specific examples of the supercritical fluid and sub-critical fluid include carbon monoxide, carbon dioxide, ammonia, water, methanol, ethanol, ethane, propane, 2,3-dimethylbutane, benzene, chlorotrifluoromethane, dimethyl ether, etc. Among these materials, carbon dioxide is preferably used because of having a relatively low critical temperature of about 31.3° C.

Only one supercritical fluid or sub-critical fluid or a combination of two or more supercritical fluids and/or sub-critical fluids can be used in the present invention. When two or more supercritical fluids and/or sub-critical fluids are used, it is necessary for each of the materials to have a supercritical or sub-critical fluid state.

The release agent included in the toner of the present invention is preferably prepared by using a supercritical or sub-critical fluid including at least carbon dioxide.

It is preferable that the treatment temperature, at which a particulate release agent to be included in the toner of the present invention is prepared using a supercritical or sub-critical fluid, is not lower than both the critical temperature of the fluid and the melting point of the release agent. Specifically, when the treatment temperature is not lower than the melting point of the release agent, the release agent can achieve a liquid state, and the contact area of the release agent with the supercritical or sub-critical fluid can be increased, thereby making it possible to quickly dissolve the release agent in the fluid. In addition, since the release agent is in a liquid state, the flow rate of the release agent can be easily controlled. The temperature of the supercritical or sub-critical fluid is preferably 0 to 50° C. higher than the melting point of the release agent used.

The treatment pressure, at which a particulate release agent is prepared using a supercritical or sub-critical fluid, is not lower than the critical pressure of the fluid, and is preferably from 0.5 MPa to 50 MPa.

In addition, an organic solvent can be used as an entrainer in combination with a supercritical or sub-critical fluid. By adding such an entrainer, the solubility of the release agent in the supercritical or sub-critical fluid can be controlled. Specific examples of the solvent include methanol, ethanol, propanol, ammonia, melamine, urea, thioethylene glycol, etc. The added amount of such an entrainer is from 0.1% by weight to 10% by weight, and preferably from 0.5% by weight to 5% by weight, based on the weight of the supercritical or sub-critical fluid.

The release agent to be included in the toner of the present invention is not particularly limited, and any known release agents can be used. Suitable materials for use as the release agent include waxes. Specific examples of such waxes include low molecular weight polyolefin waxes (e.g., low molecular weight polyethylene waxes and low molecular weight polypropylene), synthesized hydrocarbon waxes (e.g., Fischer Tropsch wax), natural waxes (e.g., bees waxes, carnauba waxes, candelilla waxes, rice waxes and montan waxes), petroleum waxes (paraffin waxes and microcrystal waxes), higher fatty acids (e.g., stearic acid, palmitic acid and myristic acid) and metal salts thereof, higher fatty acid amides, modified waxes of these waxes, etc. These materials can be used alone or in combination.

The melting point of the release agent for use in the toner of the present invention is not particularly limited, and is preferably from 40° C. to 160° C., more preferably from 50° C. to 120° C., and even more preferably from 60° C. to 90° C. When the melting point is lower than 40° C., the high temperature preservability of the toner tends to deteriorate. By contrast, when the melting point is higher than 160° C., the toner tends to cause jamming of a recording material at a fixing device due to adhesion of a toner image on the recording material to the fixing member of the fixing device, or a cold offset problem in that when a toner image is fixed at a relatively low fixing temperature, a part of the toner image is adhered to a fixing member and the transferred image is then transferred onto another portion of the image or another image, resulting in formation of an abnormal image.

The content of a release agent in the toner is not particularly limited, and is preferably not less than 40 parts by weight, more preferably from 1 part to 40 parts by weight, and even more preferably from 3 to 30 parts by weight, based on 100 parts by weight of the toner. When no release agent is added, good releasability from a fixing member cannot be imparted to the toner. By contrast, when the content is greater than 40 parts, the low temperature fixability of the toner tends to deteriorate and image qualities deteriorate (the glossiness of images excessively increases).

The release agent to be included in the toner of the present invention is a particulate release agent prepared by heating a release agent to a temperature not lower than the melting point thereof to be melted, dissolving the melted release agent in a supercritical or sub-critical fluid, and subjecting the mixture of the release agent and the fluid to quick expansion (i.e., depressurizing) in a liquid so that the release agent is precipitated as particles in the liquid. The liquid is not particularly limited, and one or more of organic solvents mentioned later for use in preparing the toner are preferably used therefor. Alternatively, the mixture of the release agent and the fluid is subjected to quick expansion in a toner component liquid including toner components to prepare a dispersion in which particles of the release agent are dispersed in the toner component liquid. In this regard, the dispersion can be used for forming toner particles.

In one embodiment the release agent is insoluble in the liquid and the organic solvent.

One example of the manufacturing equipment for preparing a particulate release agent is illustrated in FIGURE.

Referring to FIGURE, a wax (release agent) melted in a wax tank 3 is fed to a pressure-resistant container 7 by a pump 4 through a valve 6. A supercritical fluid in a tank 1 is also fed to the container 7 by a pump 2 through a valve 5 to be mixed with the melted wax in the container 7 by an agitator 15. In this regard, the container 7 is heated by a heater 8 and the temperature and pressure in the container are measured with a thermometer 12 and a pressure gauge 13, respectively. Reference numeral 14 denotes the mixture of the supercritical fluid and the wax.

The mixture 14 is then fed into a liquid 11 (such as a polyester solution) in a container 10 while depressurized by a decompression valve 9. When the mixture 14 is fed into the liquid 11, a particulate wax 16 is formed in the liquid 11. Reference numeral 17 denotes an agitator for agitating the mixture of the particulate wax 16 and the liquid 11.

Thus, a particulate wax dispersion is prepared.

Next, the method for preparing the toner particles will be described.

The method for preparing particles of the toner of the present invention is not particularly limited, and suspension polymerization methods, dispersion polymerization methods, polymer emulsion aggregation methods, polymer solution suspension methods, polymer chain growth methods, etc. can be used. Among these methods, the polymer solution suspension methods, in which a polymer solution is dispersed in an aqueous medium to prepare toner particles, and the polymer chain growth methods, in which a prepolymer is subjected to a polymer chain growth reaction in an aqueous medium are preferably used. Particularly, polymer chain growth methods, in which a compound having an active hydrogen atom and a polymer reactive with the compound included in a toner component liquid, which optionally includes other components such as a particulate resin, a colorant, a release agent, a non-reactive polyester resin, and a charge controlling agent, are reacted in an aqueous medium to prepare a particulate binder resin (toner particles) are more preferable.

The polymer reactive with a compound having an active hydrogen atom is not particularly limited as long as the polymer has a group reactive with such a compound, and any known resins having such a group can be used. Specific examples of such resins include polyol resins, acrylic resins, polyester resins, epoxy resins, derivatives of these resins, etc. These resins can be used alone or in combination. Among these resins, polyester resins are preferably used because of having good transparency and high fluidity when melted.

The group of the polymer reactive with a compound having an active hydrogen is not particularly limited, and specific examples thereof include isocyanate, epoxy, carboxyl, and acid chloride groups. The polymer has one or more of these groups. Among these groups, isocyanate group is preferable.

The weight average molecular weight of the polymer is not particularly limited, and is preferably not lower than 1,000, more preferably from 2,000 to 1,000,000, and even more preferably from 8,000 to 100,000. When the weight average molecular weight is lower than 1,000, the hot offset resistance of the toner tends to deteriorate.

The glass transition temperature of the polymer is not particularly limited, and is preferably from 30° C. to 70° C., and more preferably from 40° C. to 65° C. When the glass transition temperature of the polymer is lower than 30° C., the high temperature preservability of the toner tends to deteriorate. When glass transition temperature of the polymer is higher than 70° C., the low temperature fixability of the toner tends to deteriorate.

The polyester polymer (hereinafter sometimes referred to as a polyester prepolymer (A) or a precursor of binder resin) having an isocyanate group is not particularly limited, and specific examples thereof include polyesters which are prepared by reacting a polyester resin having an active hydrogen atom, which is a polycondensation product of a polyol (PO) and a polycarboxylic acid (PC), with a polyisocyanate (PIC).

Suitable materials for use as the polyol (PO) include diols (DIO), polyols (TO) having three or more hydroxyl groups, and mixtures of DIO and TO. Among these diols, diols and mixtures of a diol and a small amount of polyol are preferable.

Specific examples of the diols (DIO) include alkylene glycols, alkylene ether glycols, alicyclic diols, alkylene oxide adducts of alicyclic diols, bisphenols, and alkylene oxide adducts of bisphenols, etc.

Specific examples of the alkylene glycols include ethylene glycol, 1,2-propylene glycol, 1,3-propylene glycol, 1,4-butane diol, 1,6-hexane diol, etc.

Specific examples of the alkylene ether glycols include diethylene glycol, triethylene glycol, polyethylene glycol, dipropylene glycol, polypropylene glycol, polytetramethyleneether glycol, etc.

Specific examples of the alicyclic diols include 1,4-cyclohexane dimethanol, hydrogenated bisphenol A, etc.

Specific examples of the alkylene oxide adducts of alicyclic diols include adducts of the above-mentioned alicyclic diols with an alkylene oxide (such as ethylene oxide, propylene oxide and butylene oxide).

Specific examples of the bisphenols include bisphenol A, bisphenol F, bisphenol S, etc.

Specific examples of the alkylene oxide adducts of bisphenols include adducts of the above-mentioned bisphenol compounds with an alkylene oxide (such as ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of bisphenol and an alkylene glycol having from 2 to 12 carbon atoms are used.

Suitable materials for use as the polyol (TO) include polyols having three to eight hydroxyl groups. Specific examples of the polyols (TO) include aliphatic polyalcohols having three or more hydroxyl groups (e.g., glycerin, trimethylol ethane, trimethylol propane, pentaerythritol and sorbitol); polyphenols having three or more hydroxyl groups (e.g., trisphenol PA, phenol novolak and cresol novolak); and alkylene oxide adducts of polyphenols (e.g., alkylene oxide (ethylene oxide, propylene oxide and butylene oxide) adducts of the polyphenols mentioned above.

When a mixture of a diol (DIO) and a polyol (TO) is used, the mixing ratio (DIO/TO) is preferably from 100/0.01 to 100/10 by weight, and more preferably from 100/0.01 to 100/1 by weight.

Suitable materials for use as the polycarboxylic acid (PC) include dicarboxylic acids (DIC), polycarboxylic acids (TC) having three or more carboxyl groups, and mixtures of DIC and TC. Among these polycarboxylic acids (PC), dicarboxylic acids and mixtures of a dicarboxylic acid and a small amount of polycarboxylic acid are preferable.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acids).

Among these dicarboxylic acids (DIC), alkenylene dicarboxylic acids having from 4 to 20 carbon atoms and aromatic dicarboxylic acids having from 8 to 20 carbon atoms are preferable.

Suitable materials for use as the polycarboxylic acids (TC) include polycarboxylic acids having three to eight carboxyl groups.

Specific examples of the polycarboxylic acids (TC) include aromatic polycarboxylic acids having 9 to 20 carbon atoms (e.g., trimellitic acid and pyromellitic acid).

Anhydrides and low alkyl esters (e.g., methyl, ethyl and isopropyl esters) of the polycarboxylic acids (PC) can also be used as the polycarboxylic acids (PC).

When a mixture of a dicarboxylic acid (DIC) and a polycarboxylic acid (TC) is used, the mixing ratio (DIC/TC) is preferably from 100/0.01 to 100/10 by weight, and more preferably from 100/0.01 to 100/1 by weight.

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The content of a unit obtained from the polyol component in the polyester prepolymer (A) is preferably from 0.5 to 40% by weight, more preferably from 1 to 30% by weight, and even more preferably from 2 to 20% by weight. When the content is less than 0.5% by weight, the hot offset resistance of the toner tends to deteriorate, and it becomes difficult for the toner to have a good combination of high temperature preservability and low temperature fixability. By contrast, when the content is greater than 40% by weight, the low temperature fixability of the toner tends to deteriorate.

Specific examples of the polyisocyanates (PIC) for use in preparing the polyester prepolymer (A) include aliphatic polyisocyanates (e.g., tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate and tetramethylhexane diisocyanate); alicyclic polyisocyanates (e.g., isophorone diisocyanate and cyclohexylmethane diisocyanate); aromatic diisocianates (e.g., tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'diisocyanate and diphenylether-4,4'-diisocyanate); aromatic aliphatic diisocyanates (e.g., α,α,α',α'-tetramethylxylylene diisocyanate); isocyanurates (e.g., tris-isocyanatoalkyl-isocyanurate and triisocyanatocycloalkyl-isocyanurate); etc. These compounds can be used alone or in combination.

Suitable mixing ratio (i.e., the equivalence ratio [NCO]/[OH]) of the [NCO] group of a polyisocyanate (PIC) to the [OH] group of a polyester having an active hydrogen atom (e.g., a polyester having a hydroxyl group) is from 5/1 to 1/1, preferably from 3/1 to 1.2/1 and more preferably from 1.5/1 to 1.1/1. When the [NCO]/[OH] ratio is greater than 5, the offset resistance of the toner tends to deteriorate. By contrast, when the ratio is less than 1, a problem in that the synthesized polyester prepolymer gelates tends to be caused.

The content of the unit obtained from a polyisocyanate in a polyester prepolymer (A) is from 0.5% to 40% by weight, preferably from 1% to 30% by weight and more preferably from 2% to 20% by weight. When the content is lower than 0.5% by weight, the hot offset resistance of the toner tends to deteriorate, and it becomes difficult for the toner to have a good combination of high temperature preservability and low temperature fixability. By contrast, when the content is higher than 40% by weight, the low temperature fixability of the toner tends to deteriorate.

The average number of the isocyanate group included in a molecule of a polyester prepolymer (A) is generally not less than 2, preferably from 2.0 to 2.5, and more preferably from 2.0 to 2.2. When the average number of the isocyanate group is less than 2, the hot offset resistance of the resultant toner tends to deteriorate.

The compound having an active hydrogen atom serves as a polymer chain growing agent and/or a crosslinking agent when the compound and the polymer reactive with the compound are subjected to a polymer chain growth reaction and/or a crosslinking reaction in an aqueous medium. Any known compounds having an active hydrogen atom can be used. For example, when the polymer reactive with a compound having an active hydrogen atom is a polyester prepolymer (A) having an isocyanate group, amines (B) are preferably used as the compound having an active hydrogen atom because of producing a high molecular weight material by causing a polymer chain growth reaction and/or a crosslinking reaction together with the polyester prepolymer (A).

Suitable groups for use as the group having an active hydrogen atom include hydroxyl groups (alcoholic hydroxyl groups and phenolic hydroxyl groups), amino groups, carboxyl groups, and mercapto groups. These groups can be used alone or in combination. Among these groups, alcoholic hydroxyl groups are preferable.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination. Among these amines, diamines (B1), and mixtures of a diamine (B1) and a small amount of polyamine (B2) are preferable.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptans (B4) include aminoethyl mercaptan, aminopropyl mercaptan, etc.

Specific examples of the amino acids (B5) include aminopropionic acid, aminocaproic acid, etc.

Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc.

The mixing ratio (i.e., the equivalence ratio [NCO]/[NHx]) of the [NCO] group of a polyester prepolymer (A) having an isocyanate group to the [NHx] group of an amine (B) is from 1/3 to 3/1, preferably from 1/2 to 2/1, and more preferably from 1/1.5 to 1.5/1. When the mixing ratio is less than 1/3, the low temperature fixability of the toner tends to deteriorate. When the mixing ratio is greater than 3/1, the molecular weight of the resultant polymer tends to decrease, resulting in deterioration of the hot offset resistance of the toner.

A toner component liquid, which is prepared by dissolving or dispersing toner components in a solvent, is dispersed in an aqueous medium. Suitable materials for use as the aqueous medium include water. In addition, solvents, which can be mixed with water, and mixtures of such a solvent and water can also be used.

Specific examples of the components, which can be used for preparing the toner of the present invention, include colorants, release agents, particulate inorganic materials, particulate resins, charge controlling agents, unmodified polyester resins, particulate polymers, fluidity improving agents, cleanability improving agents, magnetic materials, etc.

The colorant for use in the toner of the present invention is not particularly limited, and known dyes and pigments can be used therefor.

Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

The content of the colorant in the toner particles is preferably from 1% to 15% by weight, and more preferably from 3% to 10% by weight of the toner particles. When the content is less than 1%, the resultant toner has a low tinting power. By contrast, when the content is greater than 15%, the colorant tends to be unsatisfactorily dispersed in the toner, resulting in deterioration of the tinting power and electric properties of the toner.

Master batches, which are complexes of a colorant with a resin, can also be used as the colorant of the toner.

Specific examples of the resins used for such master batches include homopolymers of styrene or styrene derivatives, styrene copolymers, polymethyl methacrylate, polybutyl methacrylate, polyvinyl chloride, polyvinyl acetate, polyethylene, polypropylene, polyester, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Specific examples of the homopolymers of styrene or styrene derivatives include polystyrene, poly-p-chlorostyrene and polyvinyl toluene. Specific examples of the styrene copolymers include styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers, etc.

Such master batches can be prepared by mixing a resin and a colorant, and kneading the mixture while applying a high shearing force thereto. In this case, an organic solvent can be added to enhance the interaction between the colorant and the resin. In addition, a flushing method, in which an aqueous paste including a colorant and water is mixed with a resin dissolved in an organic solvent, the mixture is kneaded to transfer the colorant from the aqueous phase to the resin side (i.e., the oil phase), and then the organic solvent (and water, if desired) is removed from the kneaded mixture, can be preferably used because the resultant wet cake can be used without being dried. When performing the mixing and kneading process, dispersing devices capable of applying a high shearing force such as three roll mills can be preferably used.

The particulate inorganic material for use in the toner is not particularly limited, and any known particulate inorganic materials can be used. Specific examples thereof include silica, alumina, titanium oxide, barium titanate, magnesium titanate, calcium titanate, strontium titanate, zinc oxide, tin oxide, quartz sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These particulate inorganic materials can be used alone or in combination.

Such a particulate inorganic material preferably has a primary particle diameter of from 5 nm to 2 μm, and more preferably from 5 nm to 500 nm. The BET specific surface area of the particulate inorganic material is preferably from 20 to 500 $m^2/g$. The content of a particulate inorganic material in the toner is preferably from 0.01% to 5.0% by weight, and more preferably from 0.01% to 2.0% by weight. Such a particulate inorganic material can be preferably used as an external additive of the toner.

A particulate resin can be included in the aqueous medium for use in preparing toner particles. Any known resins capable of forming an aqueous dispersion can be used as the particulate resin. Specific examples thereof include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins and polyester resins can be preferably used because fine spherical resin particles can be easily prepared.

Specific examples of the vinyl resins include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

Copolymers including a unit obtained from a monomer having at least two unsaturated groups can also be used as the particulate resin. Specific examples of such a monomer include sodium salt of sulfate of an ethylene oxide adduct of methacrylic acid (ELEMINOL RS-30 from Sanyo Chemical Industries Ltd.), divinyl benzene, 1,6-hexaneidol diacrylate, etc.

The particulate resin preferably has a volume average particle diameter of from 20 nm to 400 nm, and more preferably from 30 nm to 350 nm. When the volume average particle diameter is less than 20 nm, the particulate resin, which typically present on the surface of the toner particles, easily forms a film, or covers the entire surface of the toner particles, thereby deteriorating adhesiveness of a binder resin included in the toner particles to a recording material, resulting in deterioration of the low temperature fixability of the toner. By contrast, when the volume average particle diameter is greater than 400 nm, the particulate resin prevents exudation of a wax from the toner particles, resulting in deterioration of the releasability of the toner, thereby causing the offset problem.

The ratio (coverage) of the surface of the toner particles covered with the particulate resin is preferably from 75% to 100%, and more preferably from 80% to 100%. When the coverage is less than 75%, the preservability of the toner tends to deteriorate, and a problem in that the toner causes blocking when stored under relatively high temperature conditions.

The content of such a particulate resin in the toner is preferably from 0.5% to 8.0% by weight, and more preferably from 0.6% to 7.0% by weight. When the content is less than 0.5% by weight, the preservability of the toner tends to deteriorate, and the toner tends to cause blocking when stored under relatively high temperature conditions. When the content is greater than 8.0% by weight, the particulate resin prevents exudation of a wax from the toner particles, resulting in deterioration of the releasability of the toner, thereby causing the offset problem.

Any known charge controlling agents can be used for the toner. However, when colored charge controlling agents are used, the color tone of the toner may change, and therefore colorless or white charge controlling agents are preferably used.

Suitable materials for use as the charge controlling agent include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination. Among these materials, metal salts of salicylic acid, and metal salts of salicylic acid derivatives are preferable. The metal of the metal salts is not particularly limited, and for example, aluminum, zinc, titanium, strontium, boron, silicon, nickel, iron, chromium and zirconium can be used. Marketed charge controlling agents can also be used. Specific examples thereof include BONTRON P-51 (quaternary ammonium salt), BONTRON E-82 (metal complex of oxynaphthoic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo dyes, polymers having a functional group such as sulfonate, carboxyl, and quaternary ammonium groups, etc.

The method for adding a charge controlling agent to the toner particles is not particularly limited. Specific examples of the method include a method in which a charge controlling agent is melted and kneaded together with a master batch including a colorant, and the mixture is dissolved or dispersed in an organic solvent to prepare a toner component liquid; a method in which a charge controlling agent is directly dissolved or dispersed in an organic solvent together with other toner components (such as binder resins, colorants, release agents, and particulate inorganic materials); or a method in which a charge controlling agent is mixed with toner particles so as to be adhered to the surface of the toner particles.

The content of the charge controlling agent in the toner is preferably determined depending on variables such as choice of binder resin, presence of additives, and the method for dispersing the charge controlling agent, but is preferably from 0.1 to 10 parts by weight, and more preferably from 1 to 5 parts by weight, per 100 parts by weight of the binder resin included in the toner. When the content is less than 0.1 parts, a good charge property cannot be imparted to the toner. By contrast, when the content is greater than 10 parts, the toner particles are excessively charged, thereby increasing the electrostatic attraction between the toner and a developing roller, resulting in formation of low density images and deterioration of fluidity of the toner.

An unmodified polyester resin is preferably included in the toner particles to improve the low temperature fixability and glossiness of the toner. Any known unmodified polyester resins can be used, and suitable polyester resins include polycondensation products of a polyol (PO) and a polycarboxylic acid (PC). It is preferable for such polyester resins to have a structure similar to the structure of the polyester prepolymer (A), i.e., to be compatible with the polyester prepolymer so that a good combination of low temperature fixability and offset resistance can be imparted to the resultant toner.

The weight average molecular weight of the unmodified polyester resin is not particularly limited, but is preferably from 1,000 to 30,000, more preferably from 1,500 to 10,000, and even more preferably from 2,000 to 8,000, which is determined by gel permeation chromatography (GPC). When the weight average molecular weight is less than 1,000, the high temperature preservability of the toner tends to deteriorate. By contrast, when the weight average molecular weight is greater than 30,000, the low temperature fixability of the toner tends to deteriorate.

The unmodified polyester resin to be included in the toner preferably has a hydroxyl value of not less than 5 mgKOH/g, more preferably from 10 to 120 mgKOH/g, and even more preferably from 20 to 80 mgKOH/g. When the hydroxyl value is less than 5 mgKOH/g, it becomes difficult to impart a good combination of high temperature preservability and low temperature fixability to the toner.

The unmodified polyester resin preferably has an acid value of from 1 to 40 mgKOH/g, and more preferably from 4 to 30 mgKOH/g. When the unmodified polyester resin has such an acid value, a good negative charge property can be imparted to the toner.

When both a polyester prepolymer (A) capable of forming a urea bond and an unmodified polyester resin (NMP) are used for forming the toner of the present invention, the mixing ratio (A/NMP) is preferably from 5/95 to 50/50 by weight.

When the ratio is less than 5/95, the hot offset resistance of the toner tends to deteriorate, and it becomes difficult to impart a good combination of high temperature preservability and low temperature fixability to the toner. By contrast, when the ratio is greater than 50/50, the low temperature fixability of the toner tends to deteriorate.

The particulate polymer for use in the toner is not particularly limited, and any known particulate polymers can be used. Specific examples thereof include polymers, polycondensation polymers and thermosetting resins (e.g., polystyrene, methacrylate-acrylate copolymers, silicone resins, benzoguanamine resins, and nylon resins) prepared by a method such as soap-free emulsion polymerization methods, suspension polymerization methods, and dispersion polymerization methods.

A fluidity improving agent can be added to the toner to improve the hydrophobicity of the toner to an extent such that the toner can maintain a good combination of fluidity and chargeability even under high humidity conditions. Specific examples thereof include silane coupling agents, silylation agents, silane coupling agents having a fluoroalkyl group, organic titanate coupling agents, aluminum coupling agents, silicone oils, modified silicone oils, etc.

A cleanability improving agent can be added to the toner so that residual toner remaining on the surface of an image bearing member can be easily removed. Specific examples thereof include stearic acid and metal salts thereof such as stearic acid, zinc stearate and calcium stearate; particulate polymers (e.g., particulate polymethyl methacrylate and particulate polystyrene), which are prepared by a method such as soap-free emulsion polymerization methods and which has a relatively sharp particle diameter distribution and a volume average particle diameter of from 0.01 μm to 1 μm.

The shape and size of the toner particles of the toner of the present invention are not particularly limited, but the toner particles preferably have the following properties.

(1) Thermal Properties

The thermal properties of toner include a softening point (Ts), flow starting point (Tfb), and ½-method softening point measured with a ½ method (T½).

These thermal properties of toner can be determined from a flow curve of the toner obtained by a flow tester CFT500 from Shimadzu Corp.

The softening point (Ts) of the toner of the present invention is preferably not lower than 50° C., and preferably from 80 to 120° C. When the softening point is lower than 50° C., at least one of the high temperature preservability and the low temperature preservability tends to deteriorate.

The flow starting point (Tfb) of the toner of the present invention is preferably not lower than 60° C., and preferably from 70 to 150° C. When the flow starting point is lower than 60° C., at least one of the high temperature preservability and the low temperature preservability tends to deteriorate.

The ½ softening point (T½) of the toner of the present invention is preferably not lower than 60° C., and preferably from 80 to 170° C. When the ½ softening point is lower than 60° C., at least one of the high temperature preservability and the low temperature preservability tends to deteriorate.

(2) Image Density

The image density of images formed by the toner of the present invention, which is measured with a spectro-densitometer X-RITE 938 from X-Rite Inc., is preferably not lower than 1.90, more preferably not lower than 2.0, and even more preferably not lower than 2.10. When the image density is lower than 1.90, the image quality deteriorates.

In this regard, the image density is measured as follows. Specifically, a toner is set in an image forming apparatus, IMAGIO NEO 450 from Ricoh Co., Ltd., and an image having a solid image is formed on a recording paper TYPE 6000 <70W> from Ricoh Co., Ltd. using the toner. The image densities of six points of the solid image are measured with the spectrodensitometer X-RITE 938 to determine the average image density of the image.

The toner of the present invention preferably has an average circularity of from 0.900 to 0.980, and more preferably from 0.950 to 0.975. In addition, it is preferable that percentage of the toner particles having a circularity of less than 0.94 in the toner is not greater than 15% by weight.

When the average circularity is less than 0.900, the toner has poor transferability and scattered toner images tend to be formed. By contrast, when the average circularity is greater than 0.980, residual toner particles on an image bearing member and intermediate transfer medium cannot be satisfactorily removed therefrom by a cleaner, thereby causing a background development problem in that the background area of images is soiled with residual toner particles and/or a contact charger contamination problem in that a contact charger used is contaminated with such residual toner particles, resulting in deterioration of the charging ability of the charger.

The average circularity of the toner is determined by the following method. Specifically, a suspension of a toner is passed through an image detection area formed on a plate, and the passing toner particles are optically caught with a CCD camera, followed by analysis of the particle image using an image analyzer. The average circularity of toner can be determined using a flow type particle image analyzer FPIA-3000 from Sysmex Corp.

The volume average particle diameter of the toner of the present invention is preferably from 3 to 8 μm. When the volume average particle diameter is less than 3 μm, and the toner is used for a two component developer, the toner tends to easily adhere to the surface of the carrier used in combination with the toner when the developer is agitated in a developing device, resulting in deterioration of the charging ability of the carrier. When such small toner is used as a one component developer, a toner film is often formed on the surface of a developing roller or the toner fixedly adheres to a blade for forming a toner layer on a developing roller, resulting in deterioration of image qualities. By contrast, when the volume average particle diameter is greater than 8 μm, it becomes difficult to produce high definition images. In addition, the particle diameter distribution of the toner in a developing device varies when developing operations are performed while the toner is supplied to the developing device, resulting in variation of image qualities.

The ratio (Dv/Dn) of the volume average particle diameter (Dv) to the number average particle diameter (Dn) of the toner of the present invention is preferably from 1.00 to 1.25, and more preferably from 1.10 to 1.25. When a toner having a ratio (Dv/Dn) of greater than 1.25 is used for a two component developer, the toner tends to easily adhere to the surface of carrier used in combination with the toner when the developer is agitated in a developing device, resulting in deterioration of the charging ability of the carrier. When a toner having a ratio (Dv/Dn) of greater than 1.25 is used as a one component developer, a toner film is often formed on the surface of a developing roller or the toner tends to fixedly adhere to a blade for forming a toner layer on a developing roller, resulting in deterioration of image qualities. In addition, the particle diameter distribution of the toner in a developing device varies when developing operations are performed while the toner is supplied to the developing device, resulting in variation of image qualities.

The volume average particle diameter and the ratio (Dv/Dn) can be measured by a particle diameter measuring instrument, COULTER COUNTER TAII from Beckman Coulter Inc.

The method for preparing the toner of the present invention includes at least a process in which a compound having an active hydrogen atom and a polymer (prepolymer) reactive with the compound are reacted in an aqueous medium to prepare toner particles while forming a binder resin constituting the toner particles, and optionally includes other processes, if necessary.

The process includes an aqueous phase liquid preparation step, an oil phase liquid preparation step, an emulsifying/dispersing step, and other steps such as a prepolymer preparation step and an active-hydrogen containing compound preparation step.

The aqueous phase liquid can be prepared, for example, by dispersing a particulate resin (such as the particulate resins mentioned above) in an aqueous medium (such as the aqueous media mentioned above). The content of such a particulate resin in the aqueous phase liquid is preferably from 0.5 to 10% by weight.

The oil phase liquid can be prepared, for example, by dissolving or dispersing toner components such as an active-hydrogen containing compound, a prepolymer reactive with the compound, a colorant, a release agent, a charge controlling agent, and an unmodified polyester resin in an organic solvent. This oil phase liquid is added to the aqueous phase liquid as mentioned below. In this regard, the toner components other than the prepolymer may be added to the aqueous phase liquid when the particulate resin is added to the aqueous phase liquid or added to the aqueous phase liquid together with the oil phase liquid.

The organic solvent used for preparing the oil phase liquid preferably has a boiling point of not higher than 150° C. so that the solvent can be easily removed after preparing toner particles. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents can be used alone or in combination. Among these solvents, ethyl acetate, toluene, xylene, benzene, methylene chloride, 1,2-dichloroethane, chloroform, and carbon tetrachloride are preferably used.

The added amount of an organic solvent is preferably from 40 to 300 parts by weight, more preferably from 60 to 140 parts by weight, and even more preferably from 80 to 120 parts by weight, based on 100 parts by weight of the toner components.

The emulsifying/dispersing step is performed by adding the oil phase liquid into the aqueous phase liquid to prepare an emulsion. In this case, the active-hydrogen containing compound and the prepolymer are subjected to a polymer chain growth reaction and/or a crosslinking reaction, a binder resin component of the toner can be formed.

When preparing such a binder resin component of the toner, for example, the following methods can be used.

(1) An oil phase liquid including a prepolymer is added to an aqueous phase liquid together with an active-hydrogen containing compound;

(2) An oil phase liquid including a prepolymer is added to an aqueous phase liquid including an active-hydrogen containing compound; and (3) After an oil phase liquid including a prepolymer is added to an aqueous phase liquid to prepare an emulsion, an active-hydrogen containing compound is added to the emulsion so that a polymer chain growth reaction and/or a crosslinking reaction is started from the interface between the oil phase liquid and the aqueous phase liquid.

When the method (3) is used, the binder resin component (modified polyester resin) is formed by priority at the surface of the toner particles, resulting in formation of toner particles in which the concentration of the modified polyester resin changes (decreases) toward the center of the toner particles.

The conditions of the reaction of forming such a binder resin component are not particularly limited, and are determined depending on the reactivity of the active-hydrogen containing compound and the prepolymer. In general, the reaction time is from 10 minutes to 40 hours, and preferably from 2 hour to 24 hours. The reaction temperature is from 0 to 150° C., and preferably from 40 to 98° C.

In order to stably disperse the oil phase liquid including at least the prepolymer, which is reactive with the active hydrogen containing compound, in the aqueous medium, a method in which a solution or dispersion in which the prepolymer is dissolved or dispersed in an organic solvent is dispersed in the aqueous medium together with other toner components such as a colorant, a release agent, a charge controlling agent, and an unmodified polyester, and the mixture is dispersed upon application of a shearing force thereto, can be used.

The method for dispersing an oil phase liquid in an aqueous medium is not particularly limited, and known dispersing methods such as low speed shearing methods, high speed shearing methods, friction methods, high pressure jet air methods, and ultrasonic methods. Among these dispersing methods, high speed shearing methods are preferably used to prepare a dispersion in which particles having an average particle diameter of from 2 μm to 20 μm are dispersed.

When a high speed shearing type dispersing machine is used, the revolution of the rotor of the dispersing machine is generally from 1,000 rpm to 30,000 rpm, and preferably from 5,000 rpm to 20,000 rpm. The dispersing time is not particularly limited, but when a batch dispersing machine is used, the dispersing time is generally from 0.1 minutes to 5 minutes. When the oil phase liquid is dispersed in the aqueous medium, the temperature of the system is generally from 0° C. to 150° C. (under pressure), and preferably from 40° C. to 98° C. In general, as the temperature increases, the dispersing operation can be easily performed.

When dispersing the oil phase liquid in the aqueous medium, the weight ratio (Aq/T) of the aqueous medium (Aq) to the toner components (T) is generally from 50/100 to 2000/100, and preferably from 100/100 to 1000/100. When the weight ratio is less than 50/100, it becomes difficult to satisfactorily disperse the toner components in the aqueous medium, and thereby toner particles having the desired particle diameter are hardly prepared. In contrast, when the weight ratio is greater than 2000/100, the production costs of the toner increase.

In order to prepare a stable emulsion having a sharp particle diameter distribution, a dispersant can be used. The dispersant is not particularly limited, and known surfactants, inorganic dispersants hardly soluble in water, polymer protection colloids, and mixtures thereof can be used. Among these dispersants, surfactants are preferable.

Suitable materials for use as the surfactant include anionic surfactants, cationic surfactants, nonionic surfactants, and ampholytic surfactants.

Among such anionic surfactants, alkylbenzene sulfonates, α-olefin sulfonates, and phosphates are preferably used. Anionic surfactants having a fluoroalkyl group are more preferably used.

Specific examples of such anionic surfactants having a fluoroalkyl group include fluoroalkyl carboxylic acids having from 2 to 10 carbon atoms and their metal salts, disodium perfluorooctanesulfonylglutamate, sodium 3-{ω-fluoroalkyl (C6-C11)oxy}-1-alkyl(C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids (C7-C13) and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyl trimethyl ammonium salts, salts of perfluoroalkyl (C6-C10)-N-ethylsulfonyl glycin, monoperfluoroalkyl(C6-C16)ethylphosphates, etc.

Specific examples of the marketed products of such anionic surfactants having a fluoroalkyl group include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 123B, 306A, 501, 201 and 204, which are manufactured by Tohchem Products Co., Ltd.; FUTARGENT F-100 and F150 manufactured by Neos; etc.

Suitable materials for use as the cationic surfactant include amine salt type surfactants, quaternary ammonium salt type surfactants, etc. Specific examples of the amine salt type surfactants include alkyl amine salts, amino alcohol fatty acid derivatives, polyamine fatty acid derivatives and imidazoline. Specific examples of the quaternary ammonium salt type surfactants include alkyltrimethyl ammonium salts, dialkyldimethyl ammonium salts, alkyldimethylbenzyl ammonium salts, pyridinium salts, alkylisoquinolinium salts and benzethonium chloride. Among these cationic surfactants, primary, secondary and tertiary aliphatic amino acids having a fluoroalkyl group, quaternary aliphatic ammonium salts having a fluoroalkyl group such as perfluoroalkyl(C6-C10)sulfoneamidepropyltrimethylammonium salts, benzalkonium salts, benzethonium chloride, pyridinium salts and imidazolinium salts are preferable.

Specific examples of the marketed products of cationic surfactants include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the nonionic surfactants include fatty acid amide derivatives, and polyhydric alcohol derivatives.

Specific examples of the ampholytic surfactants include alanine, dodecylbis(aminoethyl)glycin, bis(octylaminoethyle) glycin and N-alkyl-N,N-dimethylammonium betaine.

Specific examples of the inorganic dispersants hardly soluble in water include tricalcium phosphate, calcium carbonate, titanium oxide, colloidal silica and hydroxyapatite.

Suitable materials for use as the polymer protection colloids include homopolymers and copolymers of compounds such as acids, (meth) acrylic monomers having a hydroxyl group, vinyl alcohol or ethers of vinyl alcohol, esters of vinyl alcohol with a compound having a carboxyl group, amide compounds or methylol compound thereof, chlorides, compounds having a nitrogen atom or a heterocycle having a nitrogen atom, polyoxyalkylenes, celluloses, etc.

Specific examples of the acids include acrylic acid, methacrylic acid, α-cyanoacrylic acid, α-cyanomethacrylic acid, itaconic acid, crotonic acid, fumaric acid, maleic acid and maleic anhydride. Specific examples of the (meth)acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide. Specific examples of the vinyl alcohol or ethers of vinyl alcohol include vinyl methyl ether, vinyl ethyl ether and vinyl propyl ether. Specific examples of the esters of vinyl alcohol with a compound having a carboxyl group include vinyl acetate, vinyl propionate and vinyl butyrate. Specific examples of the amide compounds or methylol compounds thereof include acrylamide, methacrylamide, diacetoneacrylamide and their methylol compounds. Specific examples of the chlorides include acrylic acid chloride and methacrylic acid chloride. Specific examples of the monomers having a nitrogen atom or a heterocycle having a nitrogen atom include vinyl pyridine, vinyl pyrrolidone, vinyl imidazole and ethylene imine. Specific examples of the polyoxyalkylenes include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters and polyoxyethylene nonylphenyl esters. Specific examples of the celluloses include methyl cellulose, hydroxyethyl cellulose and hydroxypropyl cellulose.

When the oil phase liquid is dispersed in the aqueous medium, a dispersion stabilizer can be used.

Specific examples of the dispersion stabilizer include materials such as calcium phosphate, which can be dissolved in an acid or alkali. When calcium phosphate is used, it is preferable to remove calcium phosphate from the resultant toner particles using a method including dissolving residual calcium phosphate using hydrochloric acid, etc., and then washing the resultant toner particles with water, or a method in which calcium phosphate is decomposed using an enzyme.

When the oil phase liquid is dispersed in the aqueous medium, a catalyst for a polymer chain growth reaction and/or a crosslinking reaction can be used. Specific examples thereof include dibutyltin laurate and dioctyltin laurate.

After the oil phase liquid is dispersed in the aqueous medium and the polymer chain growth reaction and/or a crosslinking reaction is completed, the organic solvent is removed from the emulsion. Specific examples of the method include a method in which the emulsion is gradually heated to evaporate the organic solvent included in the oil phase liquid; and a method in which the emulsion is sprayed in a dry atmosphere to evaporate the organic solvent (and water) therefrom.

When the organic solvent included in the emulsion is removed, toner particles are prepared. In this regard, the toner particles may be in a wet cake state. In this case, the wet cake including toner particles is washed and then dried, followed by an optional classification treatment. The classification treatment can be performed by a wet method in which fine particles in the toner particle dispersion can be removed by a classifier such as cyclones, decanters and centrifugal separation machines, or a dry method dry in which toner particles are classified using a classifier.

The thus prepared toner particles are optionally mixed with a particulate external additive such as inorganic materials, colorants, release agents and charge controlling agents, followed by an optional treatment in which a mechanical impact is applied to the toner particles to prevent the particulate external additive from releasing from the surface of the toner particles.

Suitable mechanical impact application methods include methods in which a mixture is agitated with a highly rotated blade and methods in which a mixture is fed into jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Thus, the toner is prepared.

The developer of the present invention includes at least the toner of the present invention, and optionally includes other components such as a carrier. Namely, the developer of the present invention is a one component developer or a two component developer including the toner and a carrier. When the developer is used for high speed image forming apparatuses, a two component developer is preferable in view of life.

When the toner of the present invention is used as a one component developer, the particle diameter distribution of the developer hardly changes even when the development operations are performed while the toner is supplied to the developing device. In addition, the developer hardly causes the toner adhesion problem in that the toner adheres to the surface of the developing roller and/or the blade for forming a developer layer on the developing roller. Further, even when the developer is agitated in a developing device over a long period of time, the developer can stably produce high quality toner images.

When the developer is a two component developer including the toner of the present invention and a carrier, the developer can produce high quality toner images even when the developer is agitated in a developing device over a long period of time and the developing operations are performed while the toner is supplied to the developing device, because the particle diameter distribution of the toner hardly changes.

The carrier for use in the two component developer of the present invention is not particularly limited, and one or more proper carrier materials are selected from known carrier materials so that the resultant developer meets the purpose. However, it is preferable to use a coated carrier in which the core material thereof is coated with a resin.

Suitable materials for use as the core material include manganese-strontium (Mn—Sr) materials and manganese-magnesium (Mn—Mg) materials, which have a saturation magnetization of from 50 $Am^2/kg$ to 90 $Am^2/kg$ (50 emu/g to 90 emu/g). In view of image density, high magnetization materials such as iron powders (having a saturation magnetization of not less than 100 $Am^2/kg$ (100 emu/g) and magnetite having a saturation magnetization of from 75 $Am^2/kg$ to 120 $Am^2/kg$ (75 emu/g to 120 emu/g) are preferably used. In addition, low magnetization materials such as copper-zinc (Cu—Zn) materials having a saturation magnetization of from 30 $Am^2/kg$ to 80 $Am^2/kg$ (30 emu/g to 80 emu/g) can also be preferably used because the impact of a magnetic brush thereof against a photoreceptor can be decreased and thereby high quality images can be produced.

These carrier materials can be used alone or in combination.

The core material of a carrier for use in combination with the toner of the present invention preferably has a volume average particle diameter of from 10 μm to 150 μm, and more preferably from 40 μm to 100 μm. When the volume average particle diameter is smaller than 10 μm (i.e., the content of fine carrier particles increases), the magnetization per each carrier particle decreases, resulting in occurrence of a carrier scattering problem in that carrier particles are scattered around a developing device, resulting in contamination of devices and members in the vicinity of the developing device. By contrast, when the volume average particle diameter is larger than 150 μm, the surface area of the carrier per unit of weight decreases, thereby insufficiently charging the toner, resulting in occurrence of a toner scattering problem. In addition, when full color images having a large solid image are produced using such a developer, reproducibility of the solid image tends to deteriorate.

Specific examples of resins for use in covering the surface of a carrier for use in combination with the toner of the present invention include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, terpolymers of tetrafluoroethylene, vinylidenefluoride and other monomers including no fluorine atom, silicone resins, epoxy resins, etc. These resins can be used alone or in combination.

Specific examples of such amino resins include urea-formaldehyde resins, melamine resins, benzoguanamine resins, urea resins and polyamide resins. Specific examples of the vinyl or vinylidene resins include acrylic resins, polymethylmethacrylate resins, polyacrylonitirile resins, polyvinyl acetate resins, polyvinyl alcohol resins and polyvinyl butyral resins. Specific examples of the polystyrene resins include polystyrene resins and styrene-acrylic copolymers. Specific examples of the halogenated olefin resins include polyvinyl chloride resins. Specific examples of the polyester resins include polyethylene terephthalate resins and polybutylene terephthalate resins.

If desired, an electroconductive powder can be included in the resin layer of the carrier. Specific examples of such electroconductive powders include metal powders, carbon blacks, titanium oxide, tin oxide and zinc oxide. The average particle diameter of such electroconductive powders is preferably not greater than 1 μm. When the particle diameter is larger than 1 μm, it becomes hard to control the electric resistance of the resin layer.

The resin layer can be formed by coating a resin solution, which is prepared by dissolving a resin in a solvent, on a core material using any known coating method, followed by drying and baking. Suitable coating methods include dip coating methods, spray coating methods, brush coating methods, etc.

Specific examples of the solvent for use in the coating liquid include toluene, xylene, methyl ethyl ketone, methyl isobutyl ketone, butyl cellosolve acetate, etc.

The method of baking the coated resin layer is not particularly limited, and external heating methods and internal heating methods can be used. For example, methods using a heating device such as fixed electric furnaces, fluid electric furnaces, rotary electric furnaces and burner furnaces, and methods using microwave, are preferably used.

The weight ratio of the resin layer to the coated carrier is preferably 1/10,000 (0.01%) to 5/100 (5.0%). When the weight ratio is less than 1/10,000, a uniform resin layer cannot be formed. When the weight ratio is greater than 5/100, the carrier particles tend to aggregate, thereby unevenly charging the toner, resulting in deterioration of image quality.

When the developer is a two component developer, the content of the carrier in the developer is preferably from 90 to 98% by weight, and more preferably from 93 to 97% by weight.

Since the developer of the present invention uses the toner of the present invention, the developer can maintain good charging property, thereby forming high quality images, without emitting a foul odor in the image forming process.

The toner of the present invention can be used for known developing methods such as magnetic one component developing methods, non-magnetic one component developing methods, and two component developing methods.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Initially, the methods for evaluating properties of resins for use in Examples and Comparative Examples mentioned below will be described.

1. Molecular Weight

In the present application, the molecular weight distribution of a resin can be measured by gel permeation chromatography (GPC). The method is as follows.

(1) The column is stabilized in a chamber heated to 40° C.;

(2) Tetrahydrofuran (THF) is passed through the column heated to 40° C. at a flow rate of 1 ml/min; and (3) Then 50 μl to 200 μl of a 0.05% to 0.6% by weight THF solution of a sample is injected into the column to determine the molecular weight distribution of the sample.

The molecular weight distribution of the sample is determined using a working curve which represents the relationship between weight and GPC counts and which is previously prepared using monodisperse polystyrenes. Specific examples of the molecular weights of such monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes can be available from Pressure Chemical Co., or Tosoh Corp. It is preferable to prepare a working curve using ten or more kinds of monodisperse polystyrenes. In measurements, it is preferable to use a RI (refractive index) detector as the detector.

2. Glass Transition Temperature (Tg)

The glass transition temperature (Tg) of a resin is measured with a TG-DSC system, TAS-100 from Rigaku Corporation. The method is as follows.

(1) About 10 mg of a sample, which is contained in an aluminum container, is set on a holder unit, and the holder unit is set in an electric furnace;

(2) The sample is heated from room temperature to 150° C. at a temperature rising speed of 10° C./min, followed by heating at 150° C. for 10 minutes and cooling to room temperature; and (3) After the sample is allowed to settle at room temperature for 10 minutes, the sample is heated again from room temperature to 150° C. at a temperature rising speed of 10° C./min in a nitrogen atmosphere to obtain a DSC curve of the sample.

The glass transition temperature (Tg) of the sample is determined using an analyzing system of TAS-100. The glass transition temperature is defined as the temperature at which the tangent line of the endothermic curve crosses the base line.

Wax Dispersion Preparation Example 1

(1) Preparation of Polyester

The following components were contained in a reaction vessel equipped with a condenser, an agitator and a nitrogen feed pipe to be subjected to a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The reaction was further performed for 5 hours under a reduced pressure of from 10 to 15 mmHg (1.33 to 2.00 Pa) to prepare an unmodified polyester resin 1.

It was confirmed that the unmodified polyester resin 1 has a number average molecular weight of 2,500, a weight average molecular weight of 6,700, a glass transition temperature (Tg) of 43° C. and an acid value of 25 mgKOH/g.

(2) Preparation of Wax Dispersion WD1

A paraffin wax having a melting point of 75° C. was fed into a pressure-resistant container (such as the container 7 in FIGURE), and the wax was heated to 75° C. to be perfectly melted. A supercritical fluid of carbon dioxide having a temperature of 80° C. and a pressure of 10 MPa was fed into the container at a flow rate of 5.0 l/min (when measured under a normal condition). The mixture was fed into a 20% by weight ethyl acetate solution of the above-prepared unmodified polyester resin (serving as the liquid 11 in FIGURE) under a normal pressure (i.e., the supercritical fluid was released to air). Thus, a wax dispersion WD1 was prepared.

As a result of analysis of the wax dispersed in the unmodified polyester resin using a light scattering particle diameter measuring instrument, it was confirmed that the average particle diameter of the wax is 0.25 μm, and the weight ratio (W/R) of the wax (W) to the unmodified polyester resin (R) is 5.5/18.5.

Wax Dispersion Preparation Example 2

The procedure for preparation of the wax dispersion WD1 was repeated except that the pressure of the supercritical fluid was changed to 20 MPa.

Thus, a wax dispersion WD2 was prepared.

Wax Dispersion Preparation Example 3

The procedure for preparation of the wax dispersion WD1 was repeated except that the paraffin wax was replaced with a paraffin wax having a melting point of 70° C., the wax was heated to 70° C. in the container to be perfectly melted, and the temperature of the supercritical fluid was changed to 75° C.

Thus, a wax dispersion WD3 was prepared.

Wax Dispersion Preparation Example 4

The procedure for preparation of the wax dispersion WD3 was repeated except that the temperature of the supercritical fluid was changed to 80° C.

Thus, a wax dispersion WD4 was prepared.

Wax Dispersion Preparation Example 5

The procedure for preparation of the wax dispersion WD1 was repeated except that the paraffin wax was replaced with a carnauba wax having a melting point of 85° C., the wax was heated to 85° C. in the container to be perfectly melted, and the temperature of the supercritical fluid was changed to 90° C.

Thus, a wax dispersion WD5 was prepared.

Wax Dispersion Preparation Example 6

The procedure for preparation of the wax dispersion WD1 was repeated except that the paraffin wax was replaced with a polyethylene wax having a melting point of 105° C., the wax was heated to 110° C. in the container to be perfectly melted, and the temperature of the supercritical fluid was changed to 115° C.

Thus, a wax dispersion WD6 was prepared.

Wax Dispersion Preparation Example 7

The procedure for preparation of the wax dispersion WD1 was repeated except that the paraffin wax was not heated in the container, and the supercritical fluid was fed into the container to be mixed with the wax.

Thus, a wax dispersion WD7 was prepared.

In order to check the variation of the average particle diameter of the waxes with time, the average particle diameter of each of the waxes WD1-WD7 at a time 1 hour after preparation of the wax was also measured. The results are shown in Table 1 below.

TABLE 1

| | WD1 | WD2 | WD3 | WD4 | WD5 | WD6 | WD7 |
|---|---|---|---|---|---|---|---|
| Wax used | PAW | PAW | PAW | PAW | CAW | PE | PAW |
| Melting point of wax (° C.) | 75 | 75 | 70 | 70 | 85 | 105 | 75 |
| Heating temperature (° C.) | 75 | 75 | 70 | 70 | 85 | 110 | — |
| Supercritical fluid used | $CO_2$ | $CO_2$ | $CO_2$ | $CO_2$ | $CO_2$ | $CO_2$ | $CO_2$ |
| Temperature of fluid (° C.) | 80 | 80 | 75 | 80 | 90 | 115 | 80 |
| Pressure of fluid (MPa) | 10 | 20 | 10 | 10 | 10 | 10 | 10 |
| Particle diameter (1) (μm) | 0.25 | 0.31 | 0.22 | 0.25 | 0.31 | 0.31 | 0.27 |
| Particle diameter (2) (μm) | 0.28 | 0.33 | 0.24 | 0.29 | 0.34 | 0.33 | 0.56 |

PAW: Paraffin wax

CAW: Carnauba wax

PE: Polyethylene wax

Particle diameter (1): Average particle diameter of the wax dispersion just after preparation of the wax dispersion Particle diameter (2): Average particle diameter of the wax dispersion at a time 1 hour after preparation of the wax dispersion Next, toners were prepared using the above-prepared particulate release agent. In the below-mentioned examples and comparative example, the toners were prepared using a polymer chain growth method.

Toner Preparation Example 1

(1) Preparation of Fine Particulate Resin Emulsion for Use in Aqueous Phase Liquid The following components were fed into a reaction vessel equipped with an agitator and a thermometer to be mixed.

| | |
|---|---|
| Water | 683 parts |
| Reactive emulsifier (Sodium salt of sulfate of an ethylene oxide adduct of methacrylic acid, ELEMINOL RS-30 from Sanyo Chemical Industries Ltd.) | 11 parts |
| Styrene | 83 parts |
| Methacrylic acid | 83 parts |
| Butyl acrylate | 110 parts |
| Ammonium persulfate | 1 part |

The mixture was agitated for 15 minutes while the agitator was rotated at a revolution of 400 rpm. As a result, a white emulsion was prepared. The emulsion was heated to 75° C. to react the monomers for 5 hours.

Further, 30 parts of a 1% by weight aqueous solution of ammonium persulfate was added to the reaction product, and the mixture was aged for 5 hours at 75° C. Thus, an aqueous dispersion of a vinyl resin 1 (copolymer of styrene-methacrylic acid-butyl acrylate-sodium salt of sulfate of an ethylene oxide adduct of methacrylic acid) was prepared. This dispersion is hereinafter referred to as a fine particulate resin dispersion 1.

The volume average particle diameter of the thus prepared fine particulate resin dispersion 1 was measured using a laser diffraction/scattering particle diameter distribution measuring instrument LA-920 from Horiba Ltd. As a result, the volume average particle diameter of the fine particulate resin dispersion 1 was 105 nm. In addition, a part of the fine particulate resin dispersion 1 was heated to obtain the solid vinyl resin to measure the glass transition temperature and weight average molecular weight. As a result, the glass transition temperature and weight average molecular weight of the vinyl resin were 59° C., and 150,000, respectively.

(2) Preparation of Aqueous Phase Liquid

The following components were mixed.

| | |
|---|---|
| Water | 990 parts |
| Fine particulate resin dispersion 1 | 83 parts |
| Aqueous solution of sodium salt of dodecyldiphenyletherdisulfonic acid (ELEMINOL MON-7 from Sanyo Chemical Industries Ltd., solid content of 48.5%) | 37 parts |
| Ethyl acetate | 90 parts |

Thus, an aqueous phase liquid 1 was prepared.

(3) Preparation of Polyester Prepolymer

The following components were fed into a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 682 parts |
| Propylene oxide adduct (2 mole) of bisphenol A | 81 parts |
| Terephthalic acid | 283 parts |
| Trimellitic anhydride | 22 parts |
| Dibutyl tin oxide | 2 parts |

The reaction was further continued for 5 hours under a reduced pressure of from 10 mmHg to 15 mmHg (1.33 Pa to 2.00 Pa).

Thus, an intermediate polyester 1 was prepared.

It was confirmed that the intermediate polyester 1 has a number average molecular weight of 2,100, a weight average molecular weight of 9,500, a glass transition temperature (Tg) of 55° C., an acid value of 0.5 mgKOH/g, and a hydroxyl value of 51 mgKOH/g.

Next, the following components were fed into a reaction vessel equipped with a condenser, an agitator and a nitrogen feed pipe to be reacted for 5 hours at 100° C.

| | |
|---|---|
| Intermediate polyester 1 | 410 parts |
| Isophorone diisocyanate | 89 parts |
| Ethyl acetate | 500 parts |

Thus, a polyester prepolymer 1 having an isocyanate group was prepared. The content of free isocyanate therein was 1.53% by weight.

(4) Preparation of Ketimine Compound

In a reaction vessel equipped with an agitator and a thermometer, 170 parts of isophorone diamine and 75 parts of methyl ethyl ketone were mixed and reacted for 5 hours at 50° C. to prepare a ketimine compound 1. It was confirmed that the ketimine compound 1 has an amine value of 418 mgKOH/g.

(5) Preparation of Master Batch

The following components were mixed with a HENSCHEL MIXER mixer from Mitsui Mining Co., Ltd.

| | |
|---|---|
| Water | 1,200 parts |
| Carbon black (PRINTEX 35 from Degussa A.G., having an oil (DBP) absorption of 42 ml/100 mg and a pH of 9.5) | 540 parts |
| Polyester resin (RS801 from Sanyo Chemical Industries Ltd.) | 1,200 parts |

The mixture was kneaded with a two-roll mill for 30 minutes at 150° C., followed by roll cooling and pulverization using a pulverizer. Thus, a master batch 1 was prepared.

(6) Preparation of Oil Phase Liquid

The following components were fed into a reaction vessel equipped with an agitator and a thermometer to be mixed.

| | |
|---|---|
| Unmodified polyester resin 1 prepare above | 278 parts |
| Charge controlling agent (Metal complex of salicylic acid E-84 from Orient Chemical Industries Co., Ltd.) | 22 parts |
| Ethyl acetate | 647 parts |

The mixture was heated for 5 hours at 80° C. while agitated. The mixture was then cooled to 30° C. over 1 hour.

After the mixture was mixed with 500 parts of the master batch 1,500 parts of ethyl acetate, and 454 parts of the wax dispersion WD1, the resultant mixture was agitated for 1 hour to prepare a toner component mixture 1.

Next, 1,324 parts of the thus prepared tone component mixture 1 was fed into a container to be subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 1,042.3 parts of a 65% by weight ethyl acetate solution of the unmodified polyester resin 1 prepared above was added to the dispersion. The mixture was subjected to the dispersing treatment using the bead mill mentioned above. The conditions of this dispersing treatment were the same as those mentioned above except that the dispersing operation was performed once (i.e., one pass).

Thus, a pigment/wax dispersion 1, in which the carbon black and wax are dispersed, was prepared. The solid content of the dispersion 1, which was determined by heating the dispersion for 30 minutes at 130° C., was 50% by weight.

Next, the following components were fed into a vessel.

| | |
|---|---|
| Pigment/wax dispersion 1 | 664 parts |
| Prepolymer 1 | 109.4 parts |
| Ketimine compound 1 | 4.6 parts |

The components were mixed for 1 minute using a TK HOMOMIXER mixer from Tokushu Kika Kogyo K.K., whose rotor was rotated at a revolution of 5,000 rpm. Thus, an oil phase liquid 1 was prepared.

(7) Emulsification

One thousand and two hundred (1200) parts of the aqueous phase liquid 1 prepared above was added to 778 parts of the above-prepare oil phase liquid 1, and the mixture was mixed for 20 minutes in a vessel using a TK HOMOMIXER mixer, whose rotor was rotated at a revolution of 13,000 rpm.

Thus, an emulsion 1 was prepared.

(8) Preparation of Toner Particles

The above-prepared emulsion 1 was fed into a vessel equipped with an agitator and a thermometer, and agitated for 8 hours at 30° C. to remove the organic solvent, followed by aging for 4 hours at 40° C.

Thus, a colored particulate material dispersion 1 (i.e., dispersion of toner particles 1) was prepared. The particle diameter of the colored particulate material in the dispersion was measured with an instrument MULTISIZER II from Beckman Coulter Inc. As a result, the volume average particle diameter and number average particle diameter of the colored particulate material (toner particles 1) were 5.16 μm and 4.56 μm, respectively.

(9) Preparation of Toner

The following components were mixed with a HENSCHEL MIXER mixer.

| | |
|---|---|
| Toner particles 1 prepared above | 100 parts |
| Hydrophobized silica (RX200 from Nippon Aerosil Co., having an average particle diameter of 12 nm) | 0.8 parts |

Thus, a toner 1 (i.e., a developer 1) was prepared.

Toner Preparation Example 2

The procedure for preparation of the toner 1 in Toner Preparation Example 1 was repeated except that the wax dispersion WD1 was replaced with the wax dispersion WD2.

Thus, a toner 2 was prepared.

Toner Preparation Example 3

The procedure for preparation of the toner 1 in Toner Preparation Example 1 was repeated except that the wax dispersion WD1 was replaced with the wax dispersion WD3.

Thus, a toner 3 was prepared.

Toner Preparation Example 4

The procedure for preparation of the toner 1 in Toner Preparation Example 1 was repeated except that the wax dispersion WD1 was replaced with the wax dispersion WD4.

Thus, a toner 4 was prepared.

Toner Preparation Example 5

The procedure for preparation of the toner 1 in Toner Preparation Example 1 was repeated except that the wax dispersion WD1 was replaced with the wax dispersion WD5.

Thus, a toner 5 was prepared.

Toner Preparation Example 6

The procedure for preparation of the toner 1 in Toner Preparation Example 1 was repeated except that the wax dispersion WD1 was replaced with the wax dispersion WD6.

Thus, a toner 6 was prepared.

Toner Preparation Comparative Example 1

The procedure for preparation of the toner 1 in Toner Preparation Example 1 was repeated except that the wax dispersion WD1 was replaced with the wax dispersion WD7.

Thus, a comparative toner 1 was prepared.

The thus prepared toners 1-6 and comparative toner 1 were evaluated as follows.

1. Volume and Number Average Particle Diameters Dv and Dn of Toner

The volume average particle diameter (Dv) and number average particle diameter (Dn) of each toner were determined by an instrument COULTER COUNTER TA-II, which is manufactured by Beckman Coulter, Inc., an interface for outputting number-basis particle diameter distribution and volume-basis particle diameter distribution, and a personal computer from NEC Corp. The measurement method is as follows:

(1) A surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) Two (2) to 20 mg of a sample (i.e., a toner) to be measured is added into the mixture;

(3) The mixture is subjected to an ultrasonic dispersion treatment for about 1 to 3 minutes; and (4) The volume-basis particle diameter distribution and number-basis particle diameter distribution of the toner are measured using the instrument mentioned above and an aperture of 100 μm.

The volume average particle diameter (Dv) and number average particle diameter (Dn) of the toner and the ratio (Dv/Dn) are determined from the thus obtained volume- and number-basis particle diameter distributions.

In this case, the particle diameter channels are following 13 channels:

2.00 μm≤C1<2.52 μm; 2.52 μm≤C2<3.17 μm;
3.17 μm≤C3<4.00 μm; 4.00 μm≤C4<5.04 μm;
5.04 μm≤C5<6.35 μm; 6.35 μm≤C6<8.00 μm;
8.00 μm≤C7<10.08 μm; 10.08 μm≤C8<12.70 μm;
12.70 μm≤C9<16.00 μm; 16.00 μm≤C10<20.20 μm;
20.20 μm≤C11<25.40 μm; 25.40 μm≤C12<32.00 μm; and
32.00 μm≤C13<40.30 μm.

Thus, particles having a particle diameter not less than 2.00 μm and less than 40.30 μm are targeted in this method.

2. Glass Transition Temperature of Toner

The glass transition temperature of a toner was determined by the method mentioned above for use in determining the glass transition temperature of a resin.

3. Charge Quantity of Toner (1) 15-Second Agitation Charge Quantity

Ten (10) grams of a toner and 100 g of a ferrite carrier were mixed, and the mixture (i.e., developer) was fed in a stainless pot under environmental conditions of 28° C. and 80% RH so that the mixture occupied 30% of the volume of the pot. The developer was agitated for 15 seconds at a revolution of 100 rpm, and the charge quantity (μC/g) of the developer was measured with an instrument TB-200 from Toshiba Chemical Corp. using a blow-off method.

(2) 10-Minute Agitation Charge Quantity

The procedure for measuring the 15-second agitation charge quantity of a toner was repeated except that the developer was agitated for 10 minutes.

4. Fixing Property

A two-component developer including a toner and a ferrite cattier was set in a modified copier, MF2200 which is manufactured by Ricoh Co., Ltd. and whose fixing roller is replaced with a TEFLON roller, and copies of an original image were produced on a recording paper TYPE 6200 from Ricoh Co., Ltd. while changing the temperature of the fixing roller (i.e., fixing temperature) to determine the cold offset temperature (i.e., minimum fixable temperature), below which an offset phenomenon (at least part of the toner image adheres to the fixing roller) is caused and hot offset temperature of the toner (i.e., maximum fixable temperature), above which the offset phenomenon is caused. When the cold offset temperature was evaluated, the fixing conditions were as follows.

Feeding speed of recording paper: 120 to 150 mm/s

Fixing pressure at fixing nip formed by the fixing roller and a pressure roller: 1.2 Kgf/cm$^2$ Width at the fixing nip: 3 mm When the hot offset temperature was evaluated, the fixing conditions were as follows.

Feeding speed of recording paper: 50 mm/s

Surface pressure at fixing nip formed by the fixing roller and a pressure roller: 2.0 Kgf/cm$^2$ Width at the fixing nip: 4.5 mm Conventional low temperature fixable toners have a minimum fixable temperature of about 140° C. to 150° C.

5. High Temperature Preservability

Each toner was allowed to settle for 8 hours at 55° C. After the toner was sieved for 2 minutes using a 42-mesh screen, the percentage (i.e., residual ratio) of the toner on the sieve was determined. The high temperature preservability of toner is graded as follows.

◎: The residual ratio is less than 10%. (Excellent)

○: The residual ratio is not less than 10% and less than 20%. (Good)

Δ: The residual ratio is not less than 20% and less than 30%. (Usable)

X: The residual ratio is not less than 30%. (Unusable)

6. Image Density

A two-component developer including a toner and a ferrite carrier was set in a black image developing device of a tandem full color image forming apparatus, IMAGIO NEO 450 from Ricoh Co., Ltd., and a running test in which an image having a solid image was performed. At the beginning of the running test, the amount of toner on the solid image was controlled so as to be in a range of 1.00±0.05 mg/cm$^2$. The image density of the solid image was measured at the beginning of the running test and at the end of the running test. The image density property of toner is graded as follows.

○: The image density hardly changes during the running test. (Good)

Δ: The image density at the end of the running test is slightly lower than that at the beginning of the running test (i.e., the image quality slightly deteriorates). (Usable)

X: The image density at the end of the running test is seriously lower than that at the beginning of the running test (i.e., the image quality seriously deteriorates). (Unusable)

7. Adhesion of Toner to Image Bearing Member (Photoreceptor)

After the above-mentioned 8,000-copy running test, the surface of the photoreceptor of the image forming apparatus is visually observed to determined whether the toner adheres to the surface of the photoreceptor. The toner adhesion property is graded as follows.

○: The toner hardly adheres to the surface of the photoreceptor. (Good)

X: The toner adheres to the surface of the photoreceptor. (Unusable)

The evaluation results are shown in Table 2 below.

TABLE 2

| | Ex. 1 | Ex. 2 | Ex. 3 | Ex. 4 | Ex. 5 | Ex. 6 | Comp. Ex. 1 |
|---|---|---|---|---|---|---|---|
| Volume average particle diameter (Dv) of toner (μm) | 5.16 | 5.22 | 5.11 | 5.29 | 5.36 | 5.21 | 5.52 |
| Number average particle diameter (Dn) of toner (μm) | 4.56 | 4.53 | 4.55 | 4.62 | 4.66 | 4.55 | 4.55 |
| Dv/Dn | 1.13 | 1.15 | 1.12 | 1.15 | 1.15 | 1.15 | 1.21 |
| Glass transition temperature of toner (° C.) | 48.4 | 48.1 | 48.3 | 48.6 | 48.3 | 48.6 | 48.3 |
| Min. fixable temperature (° C.) | 135 | 135 | 135 | 135 | 135 | 135 | 140 |
| Max. fixable temperature (° C.) | 210 | 210 | 210 | 210 | 210 | 210 | 200 |
| High temp. preservability | ◎ | ◎ | ◎ | ◎ | ◎ | ◎ | ◎ |
| 15-sec agitation charge quantity (μC/g) | 27.9 | 28.5 | 27.7 | 28.9 | 27.1 | 29.3 | 25.1 |
| 1-min agitation charge quantity (μC/g) | 26.1 | 25.4 | 25.9 | 25.7 | 26.1 | 26.0 | 20.1 |
| Image density | ○ | ○ | ○ | ○ | ○ | ○ | Δ |
| Adhesion property | ○ | ○ | ○ | ○ | ○ | ○ | X |

It is clear from Table 2 that the toner of the present invention can produce high quality images for a long period of time without causing the adhesion problem while having a wide fixable temperature range, good charge stability, and high temperature preservability.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-070030, filed on Mar. 25, 2010, the entire contents of which are herein incorporated by reference.

What is claimed is:

1. A method for preparing particles of a release agent comprising:

heating a release agent to a temperature not lower than a melting point of the release agent to melt the release agent;

dissolving the melted release agent in a supercritical fluid or a sub-critical fluid; and feeding the solution into a liquid to depressurize the solution, so that the particulate release agent is formed in the liquid.

2. A method for preparing a toner including toner particles, comprising:

heating a release agent to a temperature not lower than a melting point of the release agent to melt the release agent;

dissolving the melted release agent in a supercritical fluid or a sub-critical fluid;

feeding the solution into a liquid to depressurize the solution to prepare a particulate release agent in the liquid;

dissolving or dispersing toner components including at least a compound having an active hydrogen atom, a polymer having a group reactive with the compound, a binder resin, a colorant and the particulate release agent in an organic solvent to prepare an oil phase liquid;

dispersing the oil phase liquid in an aqueous medium including a particulate resin to prepare an emulsion;

reacting the compound having an active hydrogen atom with the polymer; and removing the organic solvent from the emulsion to prepare the toner particles, wherein the solvent removing step is performed while or after the reacting step is performed.

3. The method according to claim 2, wherein the liquid into which the solution is fed is an organic solvent solution of the binder resin.

4. The method according to claim 2, wherein the release agent is insoluble in the liquid and the organic solvent.

* * * * *